United States Patent [19]

Camp

[11] 4,321,220

[45] Mar. 23, 1982

[54] METHOD OF REINFORCING PROPELLANT CHARGE

[75] Inventor: Albert T. Camp, Welcome, Md.

[73] Assignee: The United States of America as represented by the Secretary of the Navy, Washington, D.C.

[21] Appl. No.: 128,080

[22] Filed: Mar. 7, 1980

[51] Int. Cl.[3] ..... C06B 21/00

[52] U.S. Cl. ..... 264/3 R; 149/3; 149/92; 149/97; 149/98

[58] Field of Search ..... 264/3 R; 149/3, 92, 149/97, 98

[56] References Cited

U.S. PATENT DOCUMENTS 2,977,885 4/1961 Perry, Jr. et al. ..... 102/289 X 3,367,268 2/1968 Spenadel et al. ..... 102/289

*Primary Examiner*—Stephen J. Lechert, Jr.

*Attorney, Agent, or Firm*—R. S. Sciascia; A. L. Branning; T. E. McDonnell

[57] ABSTRACT

A method for strengthening a propellant charge by incorporating a support structure in the propellant charge comprises slowly traversing a flexible perforated material through a propellant lacquer until the desired loading is obtained. Reinforcement by this technique makes possible the use of a double base propellant in high-thrust, short-burning applications.

8 Claims, No Drawings

METHOD OF REINFORCING PROPELLANT CHARGE

BACKGROUND OF THE INVENTION

The present invention pertains generally to strengthening solid propellants for rocket motors and recoilless guns and in particular to improving the structural integrity of reinforced high-thrust rocket motors and other recoilless systems.

The high thrust, high mass flow, and short burning times of high-acceleration recoilless gun systems and rocket motors, such as those used in tube-launched weapon systems, place the propellant under severe shock or stress conditions which can destroy the physical integrity of the gun or rocket motor. Resulting from the cracks and the break-up of the propellant is an uncontrolled increase in the burning-surface area and thus the supply of gas. These problems plus the total impulse requirements from a system of highly constrained dimensions and weight mitigate against the use of double-base propellants in high-thrust rockets, such as tube-launched rockets, even though double-base propellants are less smokey, corrosive, expensive, and toxic than the presently used case-bonded composite propellants. The problems of smoke and toxicity are especially serious for tube-launched rockets and recoilless guns because of the close proximity of people to their use. An additional problem with presently used composite propellants is the excessive noise during combustion of the high thrust, very short-burning rockets.

Previous attempts at strengthening a double-base propellant with a reinforcing substrate involved bonding one or two thin sheets of propellant to a flexible metallic or non-metallic sheet or screen by pressure, adhesive, or curing the propellant around the substrate. All of these attempts had the problem of not producing a sufficiently strong and complete bond between the substrate and propellant as well as problems arising from the choice of substrate. Since the propellant was not securely bonded, combustion flashed into the unbonded propellant areas and caused catastrophic failure of the rocket motor and recoilless guns. Further, adhesives, when used, interfered with the propellant's combustion. The effectiveness of these previous attempts to utilize smokeless propellants was so poor that the very objectionable case-bonded composite propellants continued to be used.

SUMMARY OF THE INVENTION

It is, therefore, an object of the present invention to provide a method for reinforcing double-base propellants sufficiently to permit their use in high-thrust, short-burning applications.

Another object of the present invention is to increase the strength of the bond between propellant and a reinforcing substrate.

A further object of the present invention is to maximize the controlled burning surface of a reinforced propellant.

These and other objects are achieved by slowly coating a flexible non-metallic screen with a propellant lacquer so that the propellant dries quickly and shrinks perpendicularly to the surface of the screen.

DETAILED DESCRIPTION OF THE INVENTION

The method of the present invention is suitable for any propellant which can be made into a lacquer. While this method is applicable to composite propellants, the advantages of this invention are best realized with double-base propellants since this method permits their effective use in high-thrust rockets and recoilless guns.

The reinforcing substrate may be a screen or a perforated sheet or any other form so long as the substrate is permeable to propellant decomposition gases which evolve during storage, is sufficiently strong to withstand the severe stress and shock of a firing, and has a low density. For tube-launched rockets, it is preferred that the substrate has a mesh size from 4 to 9 meshes per centimeter.

The material of the substrate must be flexible so that the substrate can adapt to the physical behaviour of the propellant as it shrinks during drying and as the charge is stressed during a firing. It is, of course, necessary that the material be chemically compatible with the solid propellant, have a low solubility in the components of the propellant lacquer especially for nitroglycerine and other energetic plasticizers, be relatively non-combustible in a reducing atmosphere, resistant to erosion by the propellant combustion gases, have coefficients of expansion and thermal conductivity close enough to those of the propellant to be physically compatible, permit the propellant to adhere to its surface and be easily processed and formed. Examples of suitable materials include polypropylene, polyethylene, polyvinylchloride, and silicone rubbers.

The propellant lacquer is prepared by dissolving a propellent, which can be in any form e.g. powder, flake, sheet, etc., in a solvent by any of the standard techniques and preferably by those which minimize the amount of water in the propellant which is detrimental to the uniformity of the resulting propellant coating on the substrate. If a surfactant is added to prevent the water from forming discrete globules in the lacquer, a greater tolerance of water is possible. One commonly used solvent in lacquer processing is acetone because of its low cost and high soluting power for propellants. For this reason, acetone is the preferred solvent. But any other solvent which is compatible with the propellant and substrate can be used.

The method of the present invention can be practiced in a batch or continuous mode but the continuous mode is preferred because of reduced labor costs. With either technique care must be taken to ensure uniformity of propellant thickness and to prevent voids, bubbles, and other defects in the propellant. It is preferred that the resulting reinforced propellant have a waffle appearance imparted by the substrate because of the desirably increased surface area.

With either mode, a lacquer having a concentration up to about saturation, a uniform consistency, and in absence of air bubbles is prepared. Preferably, the lacquer has a concentration from about 10 to about 35 weight percent of total solution. Concentrations below 10 weight percent would require the subject method to be repeated many times in order to obtain a sufficiently thick coat on a reinforcing substrate. However, if the screen is thin and lacks stiffness, a solution below ten percent might be necessary. Concentration above 30 weight percent would increase the difficulties of maintaining uniformity in the propellant coating and of traversing the substrate through the lacquer. The most preferred concentration is from 15 to 25 weight percent of total solution.

The preferred batch technique of traversing the substrate through the propellant lacquer is by vertically dipping the substrate into the lacquer and gradually withdrawing the substrate at a rate up to about the drain rate of the lacquer, i.e. at a rate which avoids dripping. Dripping is to be avoided because of its detrimental effect on the coating. After each coating, the substrate is hung to dry. For repeated coatings, the substrate, upon removal from the lacquer, is allowed to dry until the propellant surface is no more than slightly tacky before another application is made.

The preferred continuous technique of traversing a substrate through a propellant lacquer comprises passing the substrate from a continuous roll through the propellant lacquer whereby the substrate exits without dripping from the lacquer substantially vertical to it and proceeds through an oven or similar drying means. If several coats are desired, the apparatus is modified to permit several sequential dippings and dryings.

The method of the present invention is suitable for the preparation of a continuous propellant charge or of propellant discs which are stacked to form a propellant charge. The continuous propellant charge is formed by winding laminated sheets of substrate and propellant into the desired configuration, e.g., a cylinder. Spacing among the windings, which provides increased burning surface and good control of port area for the combustion gases is most easily achieved with a corrugated screen.

the following examples are given by way of explanation and are not meant to limit this disclosure or the claims to follow.

EXPERIMENTAL SECTION I

Preparation of Propellant Charge

A 20 weight percent lacquer was prepared by dissolving and mixing, in acetone, a propellant consisting of nitrocellulose (49%), nitroglycerine (42%), 2-nitrodiphenylamine (2%), di-normal propyl adipate (1.5%), normal lead betaresorcylate (2.5%) monobasic cupric betaresorcylate (2.5%), and carbon black (0.5%). The mixing was accomplished by a slow horizontal rolling of the lacquer container at a temperature from about 15° to about 27° C. for several days. Rectangles (21.6 cm by 15.2 cm) were cut from screens consisting of 11 mil polypropylene fiber with carbon black filter, woven with 5.5 by 7 meshes per centimeter.

Just prior to use, a vacuum (380 mm Hg) was placed on the lacquer container for 10 to 20 seconds and this was repeated three times in order to bring air bubbles to the surface of the lacquer. Each screen was lowered into the lacquer vertically until the screen rectangle was just fully covered, followed by a gradual withdrawal from the lacquer at a rate not exceeding about 2.5 cm/sec. A brief pause of about five to ten seconds when the screen was half removed and another pause of about three minutes when the screen was just touching the lacquer were made during the withdrawal in order to drain excess propellant from the screen without dripping. The extra care to avoid any dripping was prompted by the air bubbles formed by dripping. Upon removal from the lacquer the screen was gently brought into contact with a solid surface in order to avoid further dripping and to prevent a build-up of excess thickness at the bottom of the screen.

The screens were individually hung on a drying rack under a hood over night and were dipped a second time in the opposite direction the following day. The second dip was done exactly as the first dip although it was easier because of the increased weight and density of the coated screen. After four hours of drying under a hood at room temperature (22° C.), the screens were trimmed with a photographic-type trimmer by successively cutting strips of approximately 0.3 cm width from all sides of the dried screens. The strips were later used as spacer strips to separate the discs cut from the coated screen rectangles.

Two full-length spacer strips were placed lengthwise on each screen rectangle so that they were 3.3 cm in from each side. The ends tacked to the screen with acetone from a dropper. Three shorter strips across the full-length strips, one exactly centered and the others 3.3 cm in from the ends. The strips were bonded at the six intersecting locations with a few drops of acetone, followed by pressing until the bond was formed. To completely bond the strips, acetone was sparingly injected along the full length of each stopper and the strips were pressed until bonding was achieved throughout the lengths of all spacer strips except in the six regions of intersection.

Discs were then cut out using a concentric cutter. The resulting discs were 0.08 to 0.1 cm in thickness and weighed 2.9 to 3.6 grams. All discs were dipped in acetone for about ten seconds each to seal cut edges. Discs weighing from about 3.3 to 3.6 grams were stacked on igniter spindles to form three propellant charges having 130 discs each and weighing approximately 450 grams. Other discs weighing from about 2.9 to 3.2 grams were stacked on an igniter spindle to form a propellant charge having 150 discs and weighing approximately 450 grams.

EXPERIMENTAL SECTION II

Testing the Propellant Charge

The above propellant charges designated as "1", "2", and "3" for the 130 disc charges and "4" for 150 disc charge were tested by firing a 2.3 kg projectile from an 81 mm recoiless gun with an 80 cm launcher stroke. The results are shown and compared with the performance of a standard tube-launched, anti-tank rocket, "5", which has a composite propellant, in Table I. The anti-tank rocket differs further from the charge tests in that the propellant weight of the anti-tank rocket was 150 grams and the projectile was about 1.2 kg.

TABLE I

| Test No. | Muzzle Velocity Ft/Sec. | Head Level Noise,* (Decibles) | Maximum Pressure psi | Breech Pressure, psi | Temp. of Round °F. | Temp. Coeff., %/°F. | Burn Time, Sec. (10% to 10%) Pressure |
|---|---|---|---|---|---|---|---|
| 1 | 765 | 176.5 | 2378 | 2335 | 140° | | 0.0087 |
| 2 | 715 | 173.5 | 2243 | 2186 | 70° | 0.055 | 0.0119 |
| 3 | 705 | 176.5 | 2108 | 2006 | −40° | | 0.0115 |
| 4 | 888 | 182 | 3000 | | 70° | | 0.0115 |

TABLE I-continued

| Test No. | Muzzle Velocity Ft/Sec. | Head Level Noise,* (Decibles) | Maximum Pressure psi | Breech Pressure, psi | Temp. of Round °F. | Temp. Coeff., %/°F. | Burn Time, Sec. (10% to 10%) Pressure |
|---|---|---|---|---|---|---|---|
| 5 | 835 | 186 | ~7000 | | 70° | 0.16 estim. | 0.006 |

The results in Table I show a significant reduction in noise and a substantial improvement in the temperature coefficient, which is an excellent indicator of the constancy of a propellant's performance. Further, the results indicate an excellent temperature independence in performance over a temperature range from −40° F. to 140° F.

EXPERIMENTAL SECTION III

Additional Tests

The charges for Tests Nos. 6–13 were prepared by the method described in I. Each test charge had 150 discs and the total weight of each test charge for Test Nos. 6 to 10 was about 425 gm, for Test Nos. 11 and 12 was about 405 gm, and for Test No. 13 was about 365 gm. An 81 mm MOUT Assault Weapon was used to fire the test charges. The chamber pressures were measured with a Bourdon gauge and the noise level was measured with Kistler gauges at these points: (1) about one foot from center line towards the nozzle end, (2) at about the nozzle end, and (3) about two feet above center of gun at the nozzle end.

TABLE II

| Test No. | Amb. Temp °F. | Mc/ Chamber Pr, psi | Av. Chamber Pr, psi | In Gun Firing Time millisec | Vel. FPS |
|---|---|---|---|---|---|
| 6 | 70 | 2712 | 1667 | 10.8 | 880 |
| 7 | 70 | 2680 | 1645 | 10.6 | 875 |
| 8 | 70 | 2980 | 1716 | 10.9 | 916 |
| 9 | 70 | 2555 | 1587 | 10.8 | 892 |
| 10 | −40 | 2320 | 1292 | 13.6 | 844 |
| 11 | 140 | 2965 | 1584 | 8.5 | 846 |
| 12 | 140 | 3000 | 1600 | 8.3 | 831 |
| 13 | 140 | 2905 | 1698 | 7.9 | 794 |

TABLE III

| Test No. | Noise level Gauge 1 db | Gauge 2 db | Gauge 3 db |
|---|---|---|---|
| 6 | 170 | 165 | 179 |
| 7 | 169.5 | 165.5 | 178 |
| 8 | 169.7 | 164.5 | 180 |
| 9 | 171.5 | 177 | 169 |
| 10 | 169.5 | 165.5 | 177.7 |
| 11 | 169 | 170 | 164 |
| 12 | 166 | 164 | 182 |
| 13 | 142 | 130 | 168 |

The results shown in Tables II and III again show excellent temperature independence in performance. The pressure and noise-level results demonstrate that the use of double-base propellants in recoilless guns is now possible. A blow-out plug was not needed for the tests because of the propellant's ease of ignition, a property resulting from both the chemistry of the propellant and the configuration of the propellant. Thus, the method of the present invention permits the elimination of the hazardous and noise-generating end plug.

Obviously, many modifications and variations of the present invention are possible in light of the above teachings. It is therefore to be understood that within the scope of the appended claims the invention may be practiced otherwise than as specifically described herein.

What is claimed and desired to be secured by Letters Patent of the United States is:

1. A method for fabricating a double-base propellant charge reinforced with a support structure which comprises:

selecting a flexible, perforated material for said support structure;

traversing said material through a double-base propellant lacquer; and drying said material upon removal from said propellant lacquer.

2. The method of claim 1 wherein said material exits from said propellant lacquer in a substantially vertical manner.

3. The method of claim 2 wherein said material exits from said lacquer at a rate less than the drip rate of said propellant lacquer.

4. The method of claim 1 wherein said material is a non-metallic screen having a mesh size from 4 to 9 meshes per centimeter.

5. The method of claim 4 wherein said propellant lacquer comprises from 10 to 35 weight percent of a double-base propellant and a solvent.

6. The method of claim 3 wherein said material is a non-metallic screen having a mesh size from 4 to 9 meshes per centimeter and said propellant lacquer comprises from 10 to 25 weight percent of a double-base propellant and a solvent.

7. The method of claim 3 wherein said material is traversed through said propellant lacquer more than once and is dried upon exiting from said lacquer sufficiently to ensure a uniform fault-free coating.

8. The method of claim 7 wherein said propellant concentration in said lacquer is from 15 to 25 weight percent.

* * * * *